US005097778A

United States Patent [19]

Niino

[11] Patent Number: 5,097,778

[45] Date of Patent: Mar. 24, 1992

[54] UPPER CLOTH FEED DEVICE FOR SEWING MACHINES

[76] Inventor: Kumao Niino, No. 301 8th Takahashi Building, No. 10-12, Minamikamada 2-chome, Ohta-ku, Tokyo, Japan

[21] Appl. No.: 733,300

[22] Filed: Jul. 22, 1991

[51] Int. Cl.[5] ..... D05B 27/04

[52] U.S. Cl. ..... 112/311; 112/320; 112/240

[58] Field of Search ..... 112/311, 320, 235, 240

[56] References Cited

U.S. PATENT DOCUMENTS

| | | | |
|---|---|---|---|
| 3,800,720 | 4/1974 | Niino | 112/235 |
| 4,503,794 | 3/1985 | Ishihara et al. | 112/320 X |
| 4,766,828 | 8/1988 | Nomura et al. | 112/320 X |
| 4,848,254 | 7/1989 | Krowatchek et al. | 112/320 X |

*Primary Examiner*—Werner H. Schroeder
*Assistant Examiner*—Paul C. Lewis
*Attorney, Agent, or Firm*—Wenderoth, Lind & Ponack

[57] ABSTRACT

An upper cloth feeding device of a sewing machine which can have a presser foot shank attached to a presser bar such that the presser foot shank need not be detached from the presser bar for removing a removable shoe from the presser foot shank. The upper cloth feeding device has a shank holder which can hold the presser foot shank therein, an upper cloth feeding foot having friction surfaces on the underneath surface thereof, a cloth presser which slidably holds the upper cloth feeding foot with friction surfaces thereon in slits disposed therein, a cloth presser holder which pivotably holds both the cloth presser and the shank holder and a lever which is pivotably connected to side walls of the cloth presser holder and to a vertical plate of the upper cloth feeding foot by means of a connector piece. By downward motion of the lever, the upper cloth feeding foot is shifted backward while touching an upper cloth, and by upward motion of the lever, the upper cloth feeding foot is lifted away from the upper cloth so as to be shifted forward.

2 Claims, 3 Drawing Sheets

UPPER CLOTH FEED DEVICE FOR SEWING MACHINES

BACKGROUND OF THE INVENTION

This invention relates to an upper cloth feed device for sewing machines which forms seams in multiple pieces of cloth consisting of an upper cloth and lower cloths. More particularly, the invention contemplates providing an upper cloth feed device which permits any type of presser foot shank which is attached to a presser bar of a sewing machine to be removably fitted with the upper cloth feed device after a shoe is removed from the shank.

An upper cloth feed device of the prior art will be described hereinafter, referring to FIG. 6 and invented by the same inventor as disclosed in Japanese Utility Model Publication No. 1982-13003. The upper cloth feed device includes a body 50 which has an upper cloth feeding foot 52, a cloth presser 54, a lever foot 56 and a lever 58. The body 50 has a groove 50*b* into which a presser foot of a sewing machine (not shown) can be fixedly positioned and a pair of foot portions 50*a*. The upper cloth feeding foot 52, provided with two-forked portions 52*a* and 52*b*, is disposed underneath the foot portion 50*a* and is slidably held on the end of the body 50. The upper cloth feeding foot 52 is also urged upwardly relative to the body 50 by a coil spring (not shown). One end of the lever foot 56 is pivotably connected to the lever 58 which is pivotably supported by the body 50 by a vertical stand 60 while the other end 56*a* is positioned on the cloth presser 54 which is located between the two-forked feet 52*a* and 52*b*. The cloth presser 54 is also connected to the body 50 by coil spring 55. One end of the lever 58 is provided with a slit 58*a* which can hold a projection 32*a* of a needle clamp 32 of a needle bar 31, as shown in FIG. 1. The lever 58 is shifted up and down simultaneously with up and down motion of the needle bar 31. When the lever 58 is shifted downward, the upper cloth feed foot 52 is pushed on the upper cloth, aided by pushing down movement of a presser bar 37, as shown in FIG. 2, fitted on the body 50, and shifted backward to feed the upper cloth in the same direction, while during transitory movement from downward to upward shifting of the lever 58, the presser 54 is pushed onto the upper cloth whereby the upper cloth feeding foot 52 is lifted upward to be shifted back to its former position.

The upper cloth feed device of the prior art described above is attached to the sewing machine presser foot and performs feeding of an upper cloth of multiple layer materials consisting of a lower cloth on which an upper cloth is placed, in conjunction with forming seams in the materials. It is a common occurrence that a single layer material is sewn by a sewing machine, at which time a presser foot fitted with a removable shoe is used. Therefore, when an operator intends to perform sewing double or multiple layer materials, he has to remove the presser foot assembly for a single layer material which has heretofore been explained from the sewing machine presser bar and replace it with the upper cloth feed device.

SUMMARY OF THE INVENTION

An object of the present invention is to provide an upper cloth feed device comprising a presser foot holder which can receive a presser foot which can be used for a single layer material and which can be removed while the presser foot is still attached to the presser bar of a sewing machine. Therefore, the upper cloth feed device of this invention eliminates the need for detaching a presser foot assembly for a single layer of material from the presser bar of a sewing machine and replacing it with an upper cloth feed device when a double layer material is to be stitched whereby efficient stitching of double layer materials can be carried out without losing time.

Another object of the present invention is to provide a cam means to facilitate the shifting of a cloth presser holder and an upper cloth feeding foot.

A further object of the present invention is to provide an upper cloth feed device which is partially accommodated in a cover for protecting against damage.

Other and further objects of the present invention will become clear from an understanding of the illustrative embodiments about to be described or claimed in the appended claims, and various further advantages not referred to herein will occur to one skilled in the art upon employment of the invention.

DETAILED DESCRIPTION OF THE DRAWINGS

DETAILED DESCRIPTION OF THE INVENTION

Figure 1:
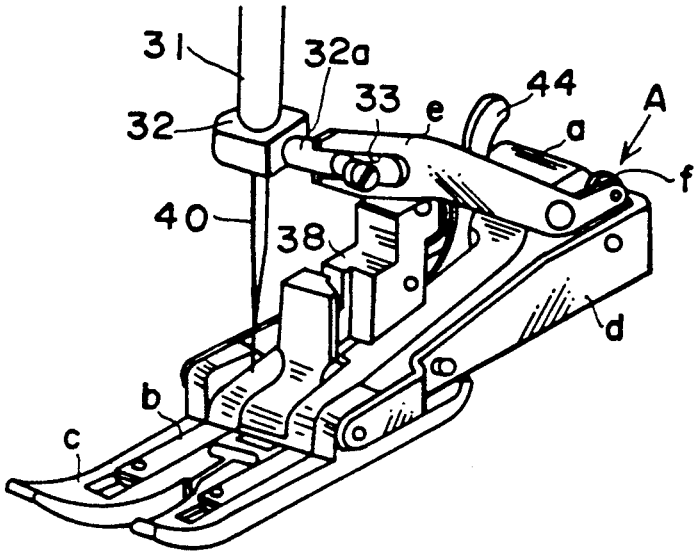
FIG. 1 is a perspective side view of an upper cloth feed device embodying the invention.
Figure 2:
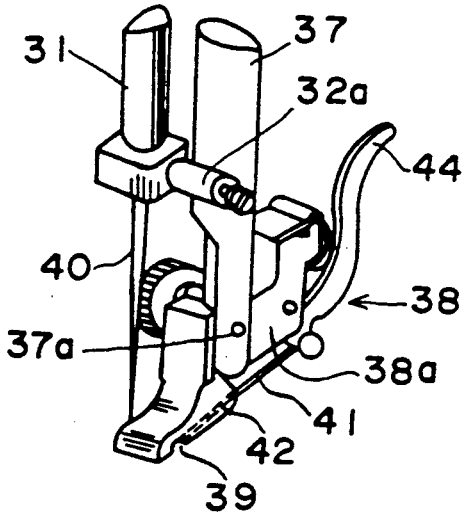
FIG. 2(A) is a perspective side view of a presser foot shank of the device of FIG. 1.
FIG. 2(B) is a perspective side view of a presser foot shank holder of the device of FIG. 1.
Figure 2:
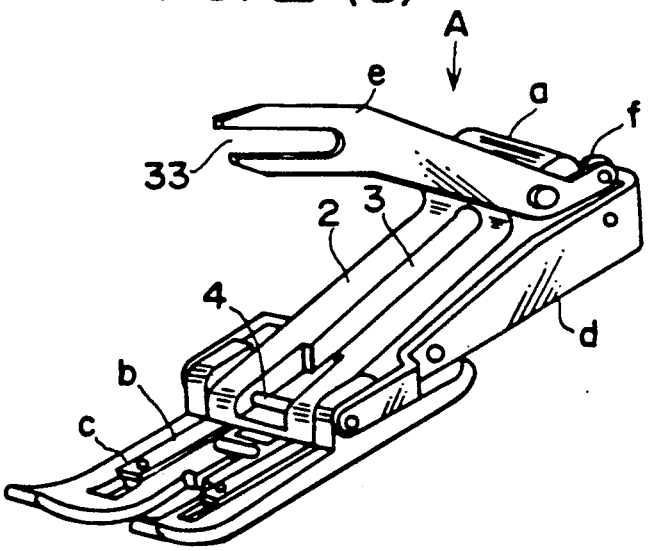
Figure 3:
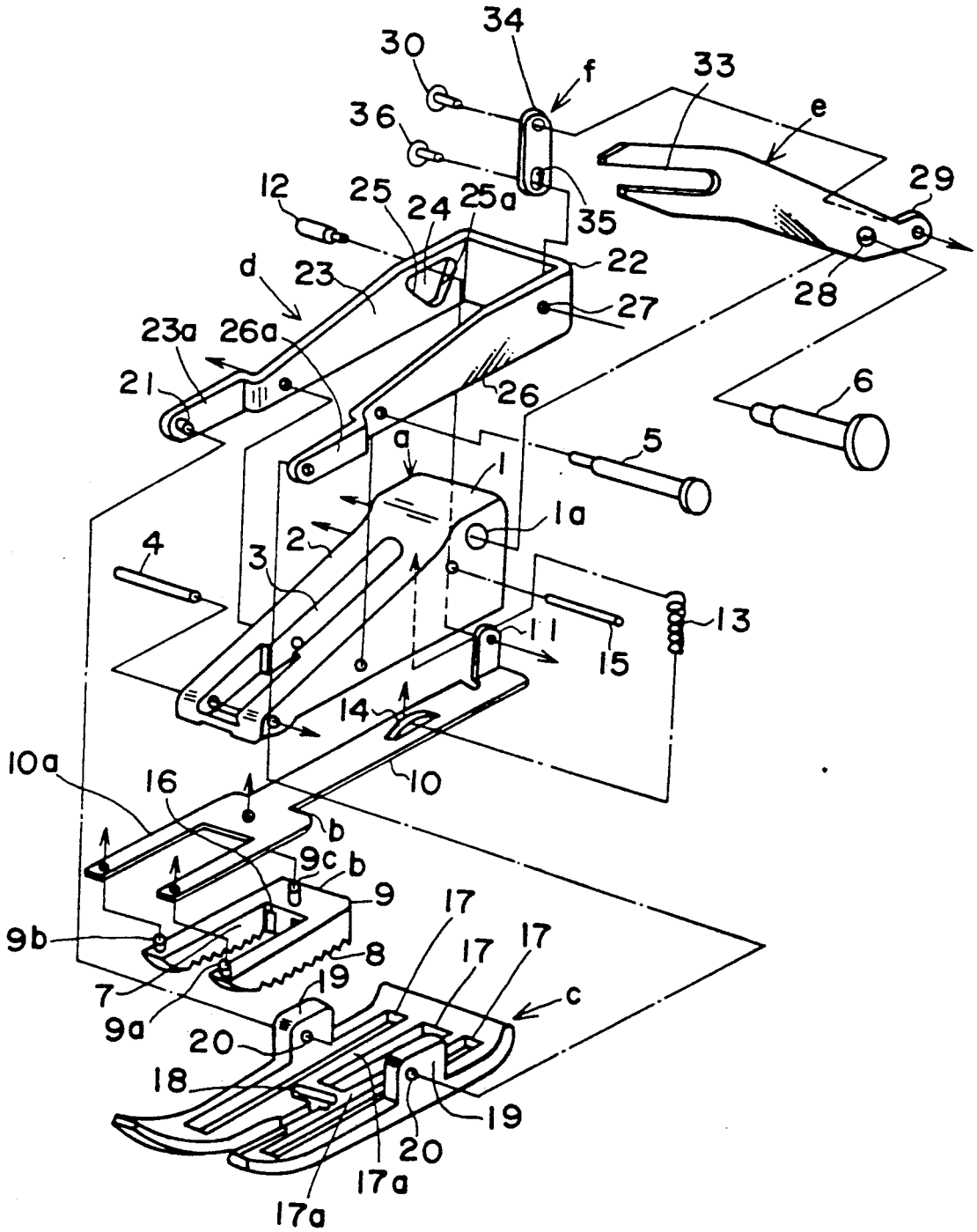
FIG. 3 is an exploded perspective view of a presser foot shank holder as shown in FIG. 2(B)

Referring to the embodiment shown in FIGS. 1-3, the upper cloth feed device A comprises a shank holder a, an upper cloth feeding foot b, a cloth presser c, a cloth presser holder d, a lever e and a connector piece f.

The shank holder a consists of a body 1 and a slant foot 2 in which a slit 3 is defined. The slit 3 can receive a presser foot shank 38, as described below. One end of the foot 2 fixedly supports a horizontal shaft 4 which can be held by a forward end of a rod 41 underneath thereof by means of the biasing force of a lever 44, as shown in FIG. 2(A) and as will be explained hereinafter. The lever 3 is pivotably mounted on one side of the body 1 on a shaft 6 extending through a hole 28 in the lever e and a through hole 1*a* defined in the body 1. Side walls 23 and 26 of the cloth presser holder d are pivotably connected to the slant foot 2 of the body 1 by means of shaft 5.

Figure 5:
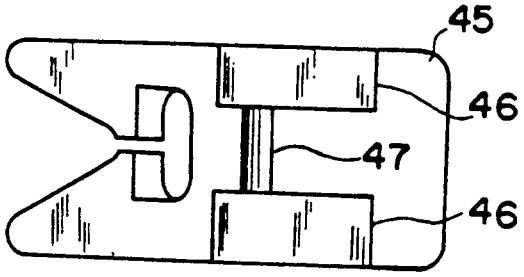
FIG. 5 is a plan view of a shoe which is removably attachable to a shank of the presser foot.
Figure 6:
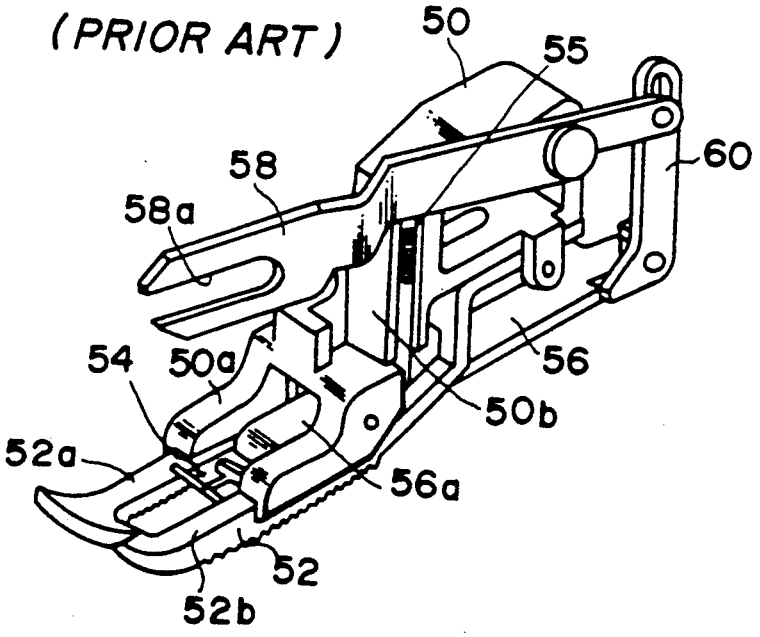
FIG. 6 (PRIOR ART)
FIG. 6 is a perspective side view of an upper cloth feed device of the prior art.

The presser foot shank 38, as shown in FIG. 2(A), has a body 38*a* attachable to a presser bar 37 by means of a screw 37*a*. A longitudinal recess 39 is defined at one end of the body 38*a* into which the rod 41 pivotably connected to a lever 44 is shifted longitudinally through a hole 42 in the shank body 38. When the lever 44 is rotated clockwise, a shaft 47 mounted on supports 46 of a removable shoe 45, as shown in FIG. 5, is held from underneath by the rod 41 such that the shoe 45 is held in the longitudinal recess 59 so as to be attached to the presser foot shank 38. The rod 41 is retracted from the recess 39 when the lever 44 is rotated counterclockwise, whereby the shoe 45 can be detached from the presser foot shank 38.

In the same way, the presser foot shank 38 can be assembled with the shank holder a with its body 38*a* being inserted into the slit 3 of the shank holder a and its recess 39 holding the shaft 4 of the shank holder a supported from underneath by the rod 41. Thus, the rod 41 is shifted forward into the recess 39, corresponding to a counterclockwise rotation of the lever 44 by means of the biasing force of a spring (not shown) mounted on the lever 44, whereby the presser foot shank 38 is assembled with the shank holder a.

The upper cloth feeding foot b consists of a plate 10 and a foot 9. The plate 10 is provided with a two-forked foot 10*a* at one end thereof and a vertical plate 11 at the other end thereof. The foot 9 is U-shaped, having a two-forked foot 7. Uneven friction surfaces are provided on the bottom of the U-shaped foot. Numeral 16 designates slits disposed in the wall of the foot 9. The flat plate 10 is assembled with the foot 9 by the insertion of projections 9*a*, 9*b* and 9*c* on the foot 9 into holes in the two-forked foot 10*a*.

The vertical plate 11 is provided with a cam shaft 12 protruding therefrom through a triangular hole 24 provided in a side wall 23 of the cloth presser holder d. The cam shaft 12 is respectively engageable with a front cam surface 25 and a rear cam surface 25*a* on the inside wall of the triangular hole 24, corresponding to a forward and backward shifting of the flat plate 10. A coil spring 13 extends between a horizontal shaft 15 disposed in the body 1 of the shank holder a and a hook 14 on the flat plate 10, whereby the flat plate 10 is held against the underneath surface of the shank holder a.

The cloth presser c has three parallel guide slits 17 and a needle hole 18 therein and a pair of supports 19 provided with a through hole 20 respectively. The U-shaped foot 9 of the upper cloth feeding foot b is insertable into the three parallel guide slits 17 with its slits 16 engaging a portion 17*a* positioned between the guide slits 17 and is slidable along the parallel slits 17.

The cloth presser holder d has a wall 22 extending between the side walls 23 and 26. A pair of projections 21 on the inside surfaces of arms 23*a* and 26*a* of the cloth presser holder d are inserted into through holes 20 in the supports 19 of the cloth presser c, and side walls 23 and 26 of the cloth presser holder d simultaneously hold the body 1 of the shank holder a and form both sides thereof.

The lever e is pivotably supported by a body 1 of the shank holder a on the shaft 6 inserted into a hole 28 therein and through a hole 1*a* in the body 1 of the shank holder a, as will be explained later. The connector piece f is mounted on the inside of the side wall 26 of the cloth presser holder d by means of a pin 36 inserted into holes 35 and 27 in the connector f and in the side wall 26 respectively. An end 29 of the lever e is pivotably supported by the connector piece f by means of a pin 30 inserted through a hole 34 in the connector piece f and a hole in the lever e. A slit 33 is provided at the other end of the lever e.

The operation of the upper cloth feed device of this invention will be explained hereinafter.

First of all, the shoe 45 is removed from the presser foot shank 38 attached to the presser bar 37 when the needle bar 31 is kept at its highest position, as heretofore explained. The shank 37 is pushed down into the slit 3 in the body 1 of the shank holder a so that the shaft 4 will be engaged within the longitudinal recess 39, and the body 38*a*, when the lever 44 is rotated in a reverse direction, that is the clockwise direction, the end of the rod 41 is positioned to hold the shaft 4 from underneath whereby the presser foot shank 38 is assembled with the upper cloth feed device A. The lever e is pivotably attached by the slit 33 at the end thereof to a projection 32*a* of a needle clamp 32 mounted on the needle bar 31 holding a needle 40 therein. Then, the presser bar 37 is shifted down to a position whereat the upper cloth feed device A touches the upper cloth of a multiple layer of material while the needle bar 31 and the lever e are kept at the high position.

At this position, the upper cloth feeding foot b touches the upper cloth while the cloth presser c is lifted away from the upper cloth without touching thereon. When the lever e is shifted down corresponding to the downward movement of the needle bar 31, the end 29 of the lever e is lifted upward to shift the cloth presser holder d counterclockwise by means of the connector piece f. With the counterclockwise shifting of the cloth presser holder d supported by the shaft bridging the side walls 23 and 26 and extending through the body 1 of the shank holder d, the triangular hole in the wall 23 is shifted upward whereby the rear cam surface 25*a* slidably engages the cam shaft 12 fitted to the vertical plate 11 of the flat plate 10, thereby to push the upper cloth feeding foot b backward. Simultaneously, the foot 9 provided with friction surfaces 8 is pushed in the same direction while touching the upper cloth whereby the upper cloth is forced to move backward. The backward movement of the foot 9 is limited to the length of guide slits 17 in which the foot 9 with the friction surfaces 8 is slidably held. The flat plate 10 fitted with the foot 9 slides backward along the lower surface of the body 1 of the shank holder a in conjunction with the movement of the cam 12 touching the rear cam surface 25*a*, as heretofore explained.

At the final stage of the shift-down motion of the lever e, the needle 40 begins to piece the upper and lower cloth in conjunction with the shifting down motion of the needle bar 31 and the cloth presser c continuously presses the upper cloth until a stitch formation is completed by needle thread (not shown) and bobbin thread (not shown). Until the needle 40 is shifted upward, the cloth presser c continuously presses the upper cloth while the upper cloth feeding foot b is lifted upward by means of the biasing force of the coil spring 3.

Corresponding to the upward motion of the lever 3, the cloth presser holder d is shifted down by means of connector piece f whereby the cloth presser c which is connected to the arms 23*a* and 26*a* of the cloth presser holder side walls 23 and 26 by a projection 12, and through holes 20 of the supports 19 of the cloth presser c is shifted upward pivotably while supported by the shaft 5 extending through the side walls 23 and 26 of the cloth presser holder d, whereby the cloth presser c is shifted up away from the upper cloth. Just before the lifting motion of the cloth presser c, the cam shaft 12 touches the front cam surface 25 such that the upper cloth feeding foot b is forced to move forward to return to its former position. During the forward motion, the upper cloth foot b is at the lifted position whereby the touching of friction surface 8 on the upper cloth is avoided. At the completion of the upward motion of the needle bar 31 and the forward motion of the upper cloth feeding foot b, the friction surfaces 8 of the foot 9 touch the upper cloth ready for the next operation.

Figure 4:
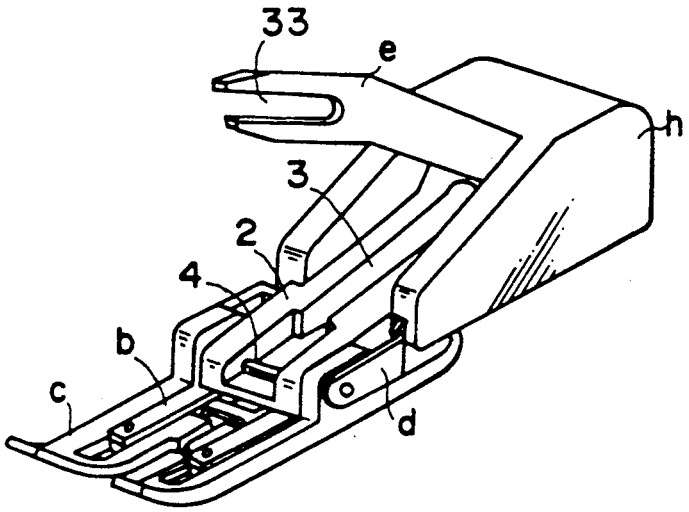
FIG. 4 is a perspective side view of another embodiment of an upper cloth feed device of the present invention.

FIG. 4 illustrates another embodiment wherein a part of the cloth feed device A is accommodated in a cover or case h to protect the device from damage.

The embodiment described heretofore provides a structure wherein a downward motion of the lever e causes the backward shifting of the upper cloth feeding foot b touching the upper cloth and an upward motion of the lever e causes the forward shifting of the cloth feeding foot b. However, it is possible to modify the structure so that the downward motion of the lever e causes the forward shifting of the cloth feeding foot b, the upward motion of the lever e, and the backward shifting of the cloth feeding foot b.

What is claimed is:

1. An upper cloth feed device for sewing machines comprising:

a shank holder provided with a slit and a shaft bridging the slit at an end thereof, the slit being arranged to receive a presser foot shank engaging with the shaft for removably holding a removable shoe thereon;

a flat plate having a two-forked foot at one end and a vertical plate provided with a cam shaft thereon integrally arranged at an other end thereof and the two-forked foot being provided with friction surfaces on the underneath side thereof; a cloth presser having guide slits therein to receive the friction surfaces of the foot, a needle hole and a pair of supports arranged on both sides thereof;

a cloth presser holder including side walls having extended arms and a triangular hole provided with a front cam surface and a rear cam surface in a side wall and slidably touchable by the cam shaft on the vertical plate, the side walls together with the extended arms pivotably holding the cloth presser and the shank holder from both sides thereof; and a lever provided with a slit at one end thereof and pivotably supported by the shank holder and having the other end thereof pivotably connected to the side wall of the cloth presser holder via a connecting piece;

whereby downward motion of the lever causes backward shifting of the upper cloth feeding foot touching an upper cloth and upward motion of the lever causes forward shifting of the cloth feeding foot to return the cloth feeding foot to its former position.

2. An upper cloth feed device for sewing machines as claimed in claim 1 further comprising a case portion of an upper cloth feed device is accommodated.

* * * * *